US008588449B2

(12) United States Patent
Ouweltjes et al.

(10) Patent No.: US 8,588,449 B2
(45) Date of Patent: Nov. 19, 2013

(54) AUDIO DRIVER

(75) Inventors: Okke Ouweltjes, Eindhoven (NL); Joris Adelbert Maria Nieuwendijk, Eindhoven (NL); Gerben Kooijman, Eindhoven (NL); Ronaldus Maria Aarts, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 43 days.

(21) Appl. No.: 13/262,927

(22) PCT Filed: Apr. 6, 2010

(86) PCT No.: PCT/IB2010/051481

§ 371 (c)(1), (2), (4) Date: Oct. 5, 2011

(87) PCT Pub. No.: WO2010/116322

PCT Pub. Date: Oct. 14, 2010

(65) Prior Publication Data

US 2012/0033843 A1 Feb. 9, 2012

(30) Foreign Application Priority Data

Apr. 10, 2009 (EP) ..... 09157800

(51) Int. Cl.
*H04R 25/00* (2006.01)

(52) U.S. Cl.
USPC ..... 381/338; 381/337; 381/349

(58) Field of Classification Search
USPC ..... 381/149, 164–166, 396–397, 412, 349, 381/337–343; 181/148, 153, 199
See application file for complete search history.

(56) References Cited

U.S. PATENT DOCUMENTS

| | | | | | |
|---|---|---|---|---|---|
| 4,210,778 | A | * | 7/1980 | Sakurai et al. | 381/349 |
| 4,757,547 | A | * | 7/1988 | Danley | 381/165 |
| 5,042,072 | A | * | 8/1991 | Button | 381/397 |
| 5,909,015 | A | * | 6/1999 | Yamamoto et al. | 181/156 |
| 5,940,522 | A | * | 8/1999 | Cahill et al. | 381/397 |

(Continued)

FOREIGN PATENT DOCUMENTS

| | | | |
|---|---|---|---|
| EP | 1715566 | A2 | 10/2006 |
| JP | 56011580 | A | 2/1981 |

(Continued)

OTHER PUBLICATIONS

Lasance et al: "Synthetic Jet Cooling Using Asymmetric Acoustic Dipoles"; IEEE 25th Annual Semiconductor Thermal Measurement and Management Symposium, Mar. 2009, pp. 254-260.

Lasance et al: "Synthetic Jet Cooling Part 1: Overview of Heat Transfer and Acoustics"; 24th Annual IEEE Semiconductor Thermal Measurement and Management Symposium, Mar. 2008, pp. 20-25.

*Primary Examiner* — Suhan Ni

(57) ABSTRACT

An audio driver including a diaphragm with a first side and a second side. The diaphragm is coupled to a transducer element on the second side and is arranged to radiate sound. The transducer element converts an electrical input signal into movement of the diaphragm. The diaphragm is arranged such that a part of the diaphragm at least partly forms a cavity at the second side of an air conduit is coupled to the cavity. The air conduit has a first opening into the cavity and a second opening outside of the cavity. The air conduit and cavity form a resonator which has a resonance frequency that is less than half a free air acoustic resonance frequency of the audio driver.

17 Claims, 3 Drawing Sheets

(56) References Cited

U.S. PATENT DOCUMENTS

| | | | | |
|---|---|---|---|---|
| 6,243,479 | B1 * | 6/2001 | Proni | 381/420 |
| 6,373,957 | B1 * | 4/2002 | Stewart | 381/397 |
| 6,390,231 | B1 | 5/2002 | Howze | |
| 6,837,333 | B2 * | 1/2005 | Howze | 181/148 |
| 6,865,281 | B1 * | 3/2005 | Jordan | 381/397 |
| 7,804,976 | B1 * | 9/2010 | Parham | 381/397 |
| 2004/0173402 | A1 | 9/2004 | Morkerken | |

FOREIGN PATENT DOCUMENTS

| | | | |
|---|---|---|---|
| JP | 4159898 | A | 6/1992 |
| JP | 6233367 | A | 8/1994 |
| WO | 2009072033 | A2 | 6/2009 |
| WO | 2010070534 | A1 | 6/2010 |

* cited by examiner

AUDIO DRIVER

FIELD OF THE INVENTION

The invention relates to an audio driver and in particular to an audio driver capable of simultaneously radiating sound and generating an air flow.

BACKGROUND OF THE INVENTION

In many applications, active cooling of e.g. electronics circuitry is desirable or necessary. Typically such cooling is implemented as air cooling using mechanical fans or in more extreme cases water or other liquid cooling.

However, it has been proposed to also use air cooling based on acoustic coolers that generate an air flow. Indeed, it has been shown that in many applications such acoustic cooling is advantageous as a replacement for fans for reasons of efficiency and lifetime expectancy. For these applications, the acoustic cooler is optimized to cool as much as possible while still being quiet. An acoustic cooling is typically implemented as an acoustic transducer, such as a loudspeaker, which is optimized to generate an air flow rather than to produce sound. An example of such a cooler is disclosed in European Patent Application EP07122620.3.

However, for applications and systems that employ both acoustic cooling and output sound, conventional approaches require two different loudspeakers to be used for producing sound and an air flow respectively. Specifically, conventional acoustic cooling is optimized for efficient generation of air flows while maintaining quiet operation and they therefore tend to be very inefficient for producing sound.

Hence, an improved approach would be advantageous and in particular an approach allowing increased flexibility, improved air flow generation, improved audio generation, reduced complexity, facilitated implementation and/or improved performance would be advantageous.

SUMMARY OF THE INVENTION

Accordingly, the Invention seeks to preferably mitigate, alleviate or eliminate one or more of the above mentioned disadvantages singly or in any combination.

According to an aspect of the invention there is provided an audio driver comprising: a diaphragm for radiating sound, the diaphragm having a first side and a second side and being arranged such that a part of the diaphragm at least partly forms a cavity at the second side; a transducer element coupled to the diaphragm on the second side and arranged to convert an electrical input signal into movement of the diaphragm; an air conduit coupled to the cavity and having a first opening into the cavity and a second opening outside the cavity; wherein the air conduit and cavity form a Helmholtz resonator having a resonance frequency less than half a free air acoustic resonance frequency of the audio driver.

The Inventor's have realized that it is possible to combine efficient sound production and acoustic generation of air flow. Indeed, the invention may allow improved simultaneous production of sound and air flow from a single audio driver. The audio driver may in particular provide an improved quality sound and/or an improved air flow. For example, the approach may allow a diaphragm surface area to be sufficient to provide improved quality low frequency sound, e.g. suitable for loudspeaker applications. Furthermore, an efficient, easy to manufacture, low complexity and/or low cost audio driver may be achieved that can provide dual functionalities. The invention may allow an integrated audio driver design for both sound radiation and air flow generation while at least partially separating design decisions for the sound and air flow generation.

The sound generation and air flow generation may be effectively decoupled in many embodiments by designing the audio driver such that the acoustic resonance frequency is substantially higher than the Helmholtz resonance frequency provided by the air conduit and cavity. In particular, the design may ensure a high air flow and typically jet stream formation without resulting in substantial audio artifacts. Also, an efficient and high quality sound reproduction may be achieved without this substantially degrading the air flow generation.

Specifically, the invention may allow the same movement of the diaphragm to be separated by the audio driver design such that part of that movement (typically lower frequency movement around the Helmholtz resonance frequency of the cavity and conduit) supports the air flow generation with low impact on sound reproduction whereas other parts of the movement (typically higher frequencies) supports the sound generation with low impact on the air flow generation.

The conduit may be a closed conduit having only a few (e.g. one or two) openings outside of the cavity. The conduit may be a pipe or tube having a length exceeding a square root of an area of all openings outside the cavity and/or exceeding a square root of a cross sectional area of the pipe/tube.

The audio driver may specifically generate an air flow in the form of an air jet in the direction of a longitudinal axis of the conduit. The air flow and/or air jet may be ejected from the second opening.

The audio driver may comprise only a single diaphragm or membrane. The diaphragm may be the single significant sound producing element of the audio driver. The first side of the diaphragm may correspond to the frontal direction aimed towards a listening position when in use. The first side may be towards the direction of main sound radiation for the audio driver.

The conduit may extend away from the diaphragm. The conduit may specifically not cross through a plane corresponding to the extension of the diaphragm away from the transducer element. The cavity may only be partially closed. The conduit may be the only air outlet from the cavity. In scenarios with other air outlets, the conduit may be the dominant air outlet. For example, at least 50% of air expressed from the cavity by movement of the at least part of the diaphragm may be through the air conduit.

The air conduit may be an elongated conduit. The air conduit may be substantially along an axis corresponding to a central on-axis direction for the audio driver.

The at least part of the diaphragm may specifically comprise or consist of a dust cap. This may facilitate manufacturing and provide improved decoupling between sound and air flow generation.

In accordance with an optional feature of the invention, the part of the diaphragm correspond to less than 20% of a surface area of the diaphragm.

This may allow improved sound quality and/or improved air flow generation.

In accordance with an optional feature of the invention, the resonance frequency is not above 100 Hz.

This may reduce the impact on the produced sound of the air flow generation. In particular, it may allow diaphragm movement intended to create air flow to be less audible to a listener. The feature may allow an improved decoupling between sound generation and air flow generation. In many embodiments, particularly advantageous performance may be achieved for a Helmholtz resonance frequency not above 50 Hz. A low resonance frequency may in particular allow improved decoupling between sound and air flow generation while allowing sound reproduction to extend to deep bass frequencies. It may also reduce the perceptibility of any noise resulting from the air flow generation.

In accordance with an optional feature of the invention, the air conduit comprises a pipe having a length at least three times longer than a maximum cross-sectional dimension of the pipe.

This may allow a particularly advantageous operation and performance. In particular, it may allow an improved air flow to be generated and may in many embodiments allow a jet stream to be formed and directed in a preferred direction.

In accordance with an optional feature of the invention, an area of the second opening is sufficiently small to provide jet formation for air expelled through the second opening as a consequence of the movement of the at least part of the diaphragm.

This may allow a particularly advantageous operation and performance. In particular, the stroke of the diaphragm relative to the area and shape of the second opening and the area of the at least part of the diaphragm may be such that a criterion for jet formation is met.

In accordance with an optional feature of the invention, the at least part of the diaphragm is a central part of the diaphragm.

This may allow a particularly advantageous operation, performance and/or implementation. In particular, it may allow improved driving of the diaphragm in many embodiments.

In accordance with an optional feature of the invention, the air conduit is at least partly formed through the transducer element.

This may allow a particularly advantageous operation, performance and/or implementation. In many embodiments, it may allow a particularly compact and efficient implementation.

The conduit may for at least part of the conduit be formed by the transducer element and may specifically for at least part of the conduit be formed by a permanent magnet of the transducer element. The conduit may specifically pass through the transducer element and/or the permanent magnet along a central or symmetry axis for the transducer element.

In accordance with an optional feature of the invention, the transducer element comprises a voice coil and a permanent magnet and the diaphragm is coupled to the voice coil and the cavity is at least partially formed by the permanent magnet.

This may allow a particularly advantageous operation, performance and/or implementation.

In accordance with an optional feature of the invention, there is provided a speaker arrangement comprising: an enclosure; and the audio driver described above mounted in the enclosure.

The invention may allow an improved speaker arrangement capable of simultaneously generating a sound output and an air flow (such as a directed air jet).

The audio driver may be mounted in the enclosure such that the first side faces outwardly of the enclosure and the second side faces inwardly. The audio driver may be mounted on a side of the enclosure with the diaphragm forming part of the closure of the enclosure.

The speaker arrangement may specifically be a loudspeaker.

In accordance with an optional feature of the invention, the second opening is outside the enclosure.

This may allow improved performance and/or facilitated operation in many scenarios. In particular, it may allow an increased decoupling of air flow and sound generation characteristics. For example, it may allow the enclosure to be designed for optimized sound reproduction and may allow the impact of the air flow functionality on the sound quality to be reduced.

The enclosure may form a bass reflex speaker system or may e.g. form a closed cabinet speaker system.

In accordance with an optional feature of the invention, a system acoustic resonance frequency of the speaker arrangement is at least 50% higher than the resonance frequency of the cavity and the air conduit.

This may reduce the impact on the produced sound of the air flow generation. In particular, it may allow diaphragm movement intended to create air flow to be less audible to a listener. The feature may allow an improved decoupling between sound generation and air flow generation. A low resonance frequency of the cavity and conduit relative to the lowest acoustic resonance frequency of the speaker arrangement may in particular ensure an inefficient reproduction of sounds at the frequencies generating the air flow thereby reducing the audio level resulting therefrom.

In accordance with an optional feature of the invention, the system acoustic resonance frequency is a resonance frequency of a bass reflex port for the audio driver.

The invention may provide a particularly high sound quality at lower (bass) frequencies while simultaneously providing an air flow with low impact on the audio experience of a listener.

In accordance with an optional feature of the invention, there is provided an audio system comprising the audio driver described above and further comprising a drive unit for generating the electrical input signal to comprise a narrowband air flow drive signal component and an audio signal component, the narrowband air flow drive signal having a center frequency closer to the resonance frequency than to the free air acoustic resonance frequency.

This may allow a particularly advantageous and efficient way of generating an air flow while maintaining a low impact on the sound quality of the sound reproduction.

According to an aspect of the invention there is provided a cooling arrangement comprising the audio driver described above.

The invention may allow for a particularly efficient cooling arrangement, e.g. for electronic circuitry, which can simultaneously be used for sound generation.

According to an aspect of the invention there is provided a method of generating an air flow, the method comprising providing an audio driver comprising: a diaphragm for radiating sound, the diaphragm having a first side and a second side and being arranged such that a part of the diaphragm at least partly forms a cavity at the second side; a transducer element coupled to the diaphragm on the second side and arranged to convert an electrical input signal into movement of the diaphragm; an air conduit coupled to the cavity and having a first opening into the cavity and a second opening outside the cavity; wherein the air conduit and cavity form a resonator having a resonance frequency less than half a free air acoustic resonance frequency of the audio driver; and generating an electrical drive signal comprising an air flow signal component and an audio signal component; and feeding the electrical drive signal to the transducer element as the electrical input signal.

These and other aspects, features and advantages of the invention will be apparent from and elucidated with reference to the embodiment(s) described hereinafter.

BRIEF DESCRIPTION OF THE DRAWINGS

Embodiments of the invention will be described, by way of example only, with reference to the drawings, in which.

DETAILED DESCRIPTION OF SOME EMBODIMENTS OF THE INVENTION

Figure 1:
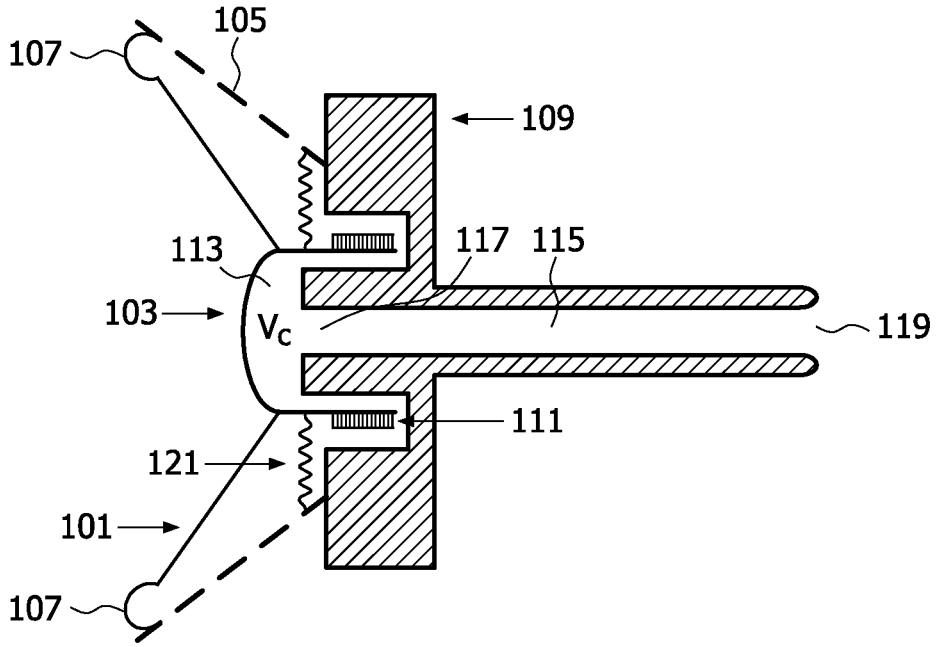
FIG. 1 illustrates an example of a cross sectional view of an audio driver in accordance with some embodiments of the invention.

FIG. 1 illustrates an example of cross sectional view of an audio driver in accordance with some embodiments of the invention. The audio driver is specifically a loudspeaker unit.

The audio driver of FIG. 1 provides dual functionalities and can be used to simultaneously generate an audio/sound output and an air flow output which for example may be used for cooling. Thus the audio driver allows different functionalities to be implemented by a single driver and can for example be implemented in an electronic device, such as a computer, to provide simultaneous sound generation and acoustic cooling.

The audio driver comprises a diaphragm which in the specific example is made up by a membrane 101 and a central dust cap 103. The membrane 101 is attached to a speaker frame 105 by an elastic suspension 107 allowing the diaphragm to move relative to the speaker frame. The speaker frame is fixedly connected to a transducer element 109, 111 which comprises a fixed part 109 (which is fixed relative to the speaker frame 105) and a movable part 111 (which is moveable relative to the speaker frame 105). The moveable part 111 of the transducer element 109, 111 is connected to one side of the diaphragm, henceforth referred to as the rear side of the diaphragm.

The transducer element 109, 111 can receive an alternating electrical signal resulting in the corresponding alternating relative movement between the fixed part 109 and the moveable part 111. In the example of FIG. 1, the fixed part 109 is formed by a permanent magnet whereas the moveable part 111 is formed by a voice coil, and the parts will in the following partly be referred to by these terms. However, it will be appreciated that in other embodiments, other arrangements may be employed, such as for example a static voice coil and a moveable permanent magnet.

In the example of FIG. 1 a varying electrical signal is fed to the voice coil 111. The resulting varying magnetic field interacts with the magnetic field of the permanent magnet to move the voice coil 111 and thus the diaphragm. The electrical signal specifically comprises an audio signal component that causes the diaphragm to generate a sound output. The quality of this sound output may be high and may extend to relatively low frequencies due to the possibility of using a relatively large diaphragm.

The audio driver of FIG. 1 is furthermore constructed such that part of the diaphragm at least partly forms a cavity 113 on the rear side of the diaphragm. In the specific example, the part of the diaphragm which (partially) forms the cavity 113 corresponds to the dust cap 103 but it will be appreciated that in other embodiments, other parts of the diaphragm may form the cavity 113. The use of the dust cap 103 to form the cavity 113 provides a particularly advantageous implementation as it facilitates manufacturing and uses an already present (in many speaker designs) component to perform the additional functionality. Furthermore, the use of a dust cap may provide improved decoupling of functionalities for generating an air flow and for generating sound. Also, dust caps tend to have geometries (both in terms of size and shape) that are particularly suitable. For example, the dust cap 103 has a concave shape that provides a larger volume of air within the cavity 113.

In the example, the cavity 113 is substantially formed by the dust cap 103 and the transducer element 109, 111, and predominantly by the dust cap 103 and the fixed part 109 of the transducer (i.e. the permanent magnet 109).

The audio driver furthermore comprises an air conduit 115 which is coupled to the cavity and which has a first opening 117 into the cavity and a second opening 119 into a free air space outside the audio driver. In the specific example, the air conduit 115 is formed by a substantially cylindrical pipe or tube. However, it will be appreciated that in other embodiments other air outlets may be used and that the audio driver may for example use an air conduit having different or varying cross sections and/or may comprise a plurality of air conduits.

In some examples, the cavity 113 may be completely closed apart from the air conduit 115 (i.e. the only opening in the cavity may be the first opening 117). However, in other embodiments, the cavity 113 may only be partially closed (apart from the first opening 117).

In the audio driver of FIG. 1, some leakage may occur through the air gap around the voice coil 111. However, in most embodiments, minor leakage is acceptable and is typically kept low by maintaining the acoustic resistance of any air gap high in comparison to the losses of the air conduit 115. For example, in the audio driver of FIG. 1, the acoustic resistance of the air gap around the voice coil 109 is increased by including a spider 121 having a high acoustic resistance.

In many embodiments, the audio driver is constructed such that at least 60% and more preferably more than 80% or 90% of the air expressed from the cavity is expressed by the air conduit 115.

The audio driver of FIG. 1 is thus constructed to provide dual functionalities. Specifically, the audio driver radiates sound by the movement of the diaphragm in accordance with the audio signal components of the drive signal applied to the voice coil 109. The front side of the loudspeaker diaphragm (cone 101 and dust cap 103) is used to radiate sound. Also, the rear side of the cone 101 is used to radiate sound. In addition, the dust cap 103 is used to generate pressure within the cavity 113 resulting in air being expressed via the first opening 117 through the air conduit 115 and out via the second opening 119. Thus, when the dust cap 103 moves (in particular in response to an air flow signal component of the drive signal applied to the voice coil 111), the movement towards the sound transducer 109, 111 increases the pressure on the air in the cavity 113 thereby resulting in an air flow out of the air conduit 115. Thus, the audio driver is simultaneously used as a sound source and an air flow generator (a blower).

The audio driver is constructed such that it provides an effective decoupling of the different functions thereby reducing the impact of the provision of one functionality on the performance of the other.

In particular, the audio driver is constructed such that the air conduit 115 and the cavity 113 forms a resonator that has a Helmholtz resonance frequency which is no higher than half a free air acoustic resonance of the audio driver.

Thus, the cavity 113 and air conduit 115 are dimensioned and constructed such that they form a Helmholtz resonator with a Helmholtz resonance frequency $f_h$ which can be expressed by:

$$F_h = \frac{c_o}{2\pi} \cdot \sqrt{\frac{S_p}{L_p \cdot V}}$$

where, $c_0$ is the velocity of sound in air (m/s)

$S_p$ is the cross sectional area of the conduit 117, 119 ($m^2$)

$L_p$ is the length of conduit 117, 119 (m)

V=volume of the cavity 113 (m^3)

Further, this resonator is constructed such that the free air acoustic resonance of the audio driver is at least twice the resonance frequency of the cavity 113 and conduit 115 (henceforth also referred to as the air flow resonance frequency for brevity). This allows the signal fed to the voice coil 111 to have an air flow signal component that causes the diaphragm to move at a frequency around the air flow resonance frequency thereby providing a highly efficient air flow generation. Furthermore, as the air flow resonance frequency is significantly removed from the free air acoustic resonance frequency, the audio driver will provide very inefficient sound generation at this frequency and this will result in sounds resulting from the air flow signal component having low volumes and being highly attenuated. At the same time, it allows a sound signal component of the signal fed to the voice coil to be efficiently radiated without a significant impact on the performance of the air flow generation.

Particularly advantageous performance is in many embodiments provided by controlling the air flow resonance frequency to not be above 100 Hz, or even not above 60 Hz or 30 Hz in some embodiments. Such low frequencies can be achieved while using dimensions etc that are often also suitable for other speaker design requirements and preferences (e.g. overall size, audio performance etc). Furthermore, they ensure that the air flow operation is at a low frequency at which the human audio perception is very insensitive and therefore results in an even lower perceived sound from the air flow signal component. In addition, it also allows a high separation between the air flow resonance and the frequency interval used for the sound generation, thereby allowing the driver to be used even for low frequencies.

The free air resonance frequency of the audio driver may specifically be determined as the lowest resonance frequency for the audio driver. This may e.g. be determined as the lowest frequency for which a peak occurs in the sound level output when driven by a single tone with constant amplitude (and varying frequency) or may be determined analytically e.g. from the suspension stiffness and the moving mass of the audio driver.

The audio driver of FIG. 1 thus allows a single drive signal to be applied to the voice coil 111 where the single drive signal comprises both an air flow signal component and a sound reproduction signal component. The two signals are typically separated in the frequency domain such that the air flow signal component is a narrow band signal close to the air flow resonance frequency and the sound reproduction signal component includes higher frequencies and specifically may include the audio band perceptible by a human.

Figure 2:
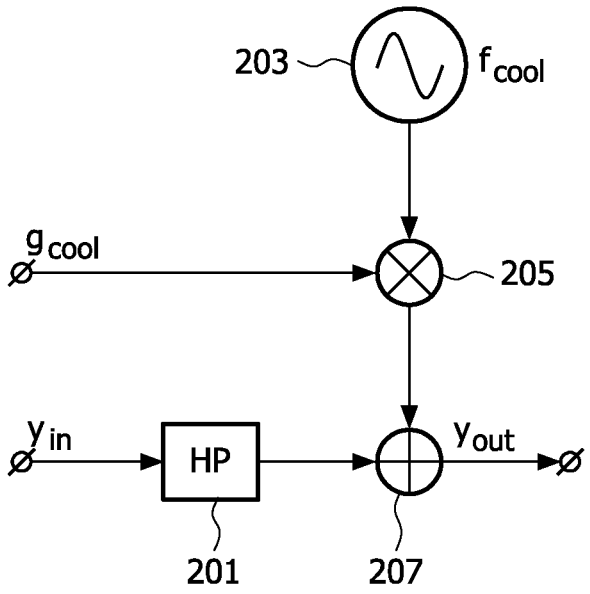
FIG. 2 illustrates an example of a drive circuit for an audio driver in accordance with some embodiments of the invention.

FIG. 2 illustrates an example of a drive system for the audio driver of FIG. 1. In the example, an audio signal $y_{in}$ is received from a suitable audio source. The audio signal $y_{in}$ is fed to a high pass filter 201 that attenuates frequencies below a given cut-off frequency which may be close to the acoustic resonance frequency. In many embodiments, the 3 dB cut-off frequency of the high pass filter 201 is advantageously in the frequency interval of [50 Hz; 150 Hz] and often even more advantageously in the frequency interval of [70 Hz; 120 Hz].

In addition, the drive system comprises an air flow signal component source 203 which generates a narrow band frequency signal with a center frequency that is close to the air flow resonance frequency of the audio driver. Specifically, the 3 dB drop off frequencies of the narrow band signal may be less than 30 Hz, and often more advantageously 20 Hz or even 10 Hz, from the air flow resonance frequency.

In the example of FIG. 2, the air flow signal component source 203 generates a single tone signal (i.e. substantially a sinusoid) with a frequency very close to the air flow resonance frequency of the audio driver. Indeed, the air flow signal component source 203 seeks to provide a tone signal with a frequency identical to the air flow resonance frequency. In many embodiments, the frequency of the generated tone signal is advantageously maintained within 10 Hz, or often even more advantageously within 5 Hz, of the air flow resonance frequency.

The air flow signal component source 203 is coupled to a gain 205 which scales the generated tone signal (with frequency $f_{cool}$) according to a gain factor $g_{cool}$. Thus, the amplitude of the resulting air flow signal component is equal to $g_{cool}$. The gain 205 is coupled to a combiner 207 to which the high pass filter 201 is also coupled. The combiner 207 combines (and in the specific example simply adds) the audio signal component from the high pass filter 201 and the air flow signal component from the gain 205 to generate a single drive signal $y_{out}$. This drive signal is then fed to the voice coil 111. Thus, a single drive signal is generated which comprises a narrowband air flow drive signal component and an audio signal component. The center frequency of the narrowband air flow drive signal is furthermore close to the air flow resonance frequency than to the free air acoustic resonance frequency of the audio driver, and may advantageously be within 30 Hz, 20 Hz or even 10 Hz of the air flow resonance frequency.

Thus, the audio driver of FIG. 1 allows for a single drive signal to be applied in order to provide both functionalities. Furthermore, the individual drive components of this signal may be individually controlled thereby providing an effective operation and decoupling. As a specific example, the air flow generation can be controlled by the scale factor $g_{cool}$ independently of the sound reproduction signal component. Thus, the amount of air flow and the sound volume levels can be individually and separately controlled.

In the example of FIG. 1, the audio driver is configured such that the generated air flow out of the second opening forms an air jet. A jet may provide a coherent stream of fluid (air) projected into a surrounding medium (air) from an opening. In the example of FIG. 1, the dimensions are selected such that when the dust cap 103 moves rearwards (towards the transducer 109, 111) then an air jet is expressed from the second opening.

This is specifically achieved by creating a sufficiently large air speed in the area 119, to result in jet formation. More specifically, the criterion for jet formation is specified by the Strouhal number which should be sufficiently small (<0.4).

$$\text{StrouhalNumber}=(f \cdot d)/v$$

$$\text{StrouhalNumber}<0.4$$

where f is the frequency of the air flow (i.e. of the air flow driving signal which is typically considered to be the Helmholtz frequency of cavity and conduit.

d is the diameter of the second opening 119 v is the velocity of air at the second opening 119

Thus, the area of the second opening 119 is designed to be sufficiently small to provide jet formation for the air expelled through the second opening 119 as a consequence of the movement of the at least part of the diaphragm.

Thus, in the example, the opening area and/or radius is maintained sufficiently low to maintain jet formation relative to the frequency and velocity of the air.

An advantage of generating such an air jet is that it can travel for long distances without dissipating. Indeed, typically a jet with a length of approximately 10 times the opening diameter can be achieved.

Furthermore, the jet formation and directional aspect of the emitted air is further enhanced by the air conduit 115 being implemented as an elongated air conduit.

Especially, the air conduit 115 is implemented as a pipe having a length that is at least three times longer than a maximum cross-sectional dimension of the pipe. Thus, for a circular pipe (i.e. the hollow opening of the pipe being circular), the maximum cross-sectional dimension is the diameter and thus the pipe is at least three times the diameter of the pipe. In some embodiments, the length of the pipe may advantageously be at least five times the maximum cross-sectional dimension The elongated nature of the air conduit 115 may furthermore facilitate directing the jet stream in a desired direction and specifically may be used to direct the jet towards an element or area to be cooled.

Also, in the example of FIG. 1, the volume of the cavity 113 is maintained relatively low relative to the area of the first opening and specifically the volume of the cavity 113 is less than $$20\cdot(\sqrt{A})^3$$

where A is the area of the first opening 117.

By maintaining the volume of the cavity relatively low, it can be ensured that even relatively low excursions of the diaphragm (and specifically the dust cap 103) allows sufficient air pressure to be generated to expel a strong jet.

Thus, the audio driver of FIG. 1 consists of a loudspeaker which is connected to a pipe or tube. The inventors have found that such a system is suitable to be used as a synthetic jet actuator. The acoustic motion of the air results in the formation of a pulsating jet at the outlet of the pipe/tube: as air is pushed out of the pipe during one half of a cycle (when the diaphragm moves towards the transducer 109, 111). Flow separation then occurs at the edges of the outlet and a jet is formed.

During the intake part of a cycle, air is sucked into the pipe but in contrast to the air output part of the cycle, this is much less directional, i.e. air is sucked in from a wide range of directions. Averaged over a complete cycle no mass is injected into the air domain. However, due to the described difference between the inward motion of air at intake and the outward motion in the form of a jet, a net momentum is injected into the air domain. Therefore, synthetic jet actuators are also known as zero-net mass flux, non-zero momentum flux devices.

In the example, the part of the diaphragm which (partially) forms the cavity and causes the air flow corresponds to the dust cap 103. However, in other embodiments other parts of the diaphragm may be used such as for example an area of the membrane 103. For example, a cavity may be formed as a small circular concentric ring equidistant to the center of the diaphragm. However, in most embodiments, the area of the part of the diaphragm which is used to form the cavity and provide the air flow is less than 20% of the total area of the diaphragm. This may allow the impact of the air flow generation on the sound reproduction to be reduced and may facilitate implementation and manufacturing in many scenarios.

Also, in the example, the part of the diaphragm which (partially) forms the cavity is a central part of the diaphragm and specifically it is a part of the diaphragm that includes the center point of the diaphragm. Thus, the part which forms the cavity and generates air flow includes the center point of symmetry for the diaphragm. This may facilitate manufacturing and provide a particularly advantageous implementation in many scenarios.

In the example, the cavity 113 is predominantly formed by the part of the diaphragm (specifically the dust cap 103) and the transducer (and specifically the fixed part 109). Furthermore, the air conduit is at least partly formed through the transducer element 109, 111 and especially is partially formed by the transducer element 109, 111. In the example, the air conduit 115 is formed by a cylindrical opening through the fixed part 109 and by a further rearwards hollow protrusion from the fixed part. This may provide a highly efficient implementation and facilitated manufacturing.

The audio driver of FIG. 1 may for example be used as part of a speaker arrangement where the audio driver is mounted in a suitable enclosure (possibly together with other audio drivers). In such systems, the audio production may be further controlled by the design of the enclosure etc.

In some such speaker arrangements, the second opening 119 is outside the enclosure. This may allow the air jet/flow to be directed towards elements or features outside the enclosure and may further allow the audio design of the enclosure and speaker arrangement to be highly independent and separate from the air flow operation. Similarly, the air flow generation and usage need not be limited by specific characteristics or requirements for the enclosure audio design.

Figure 3:
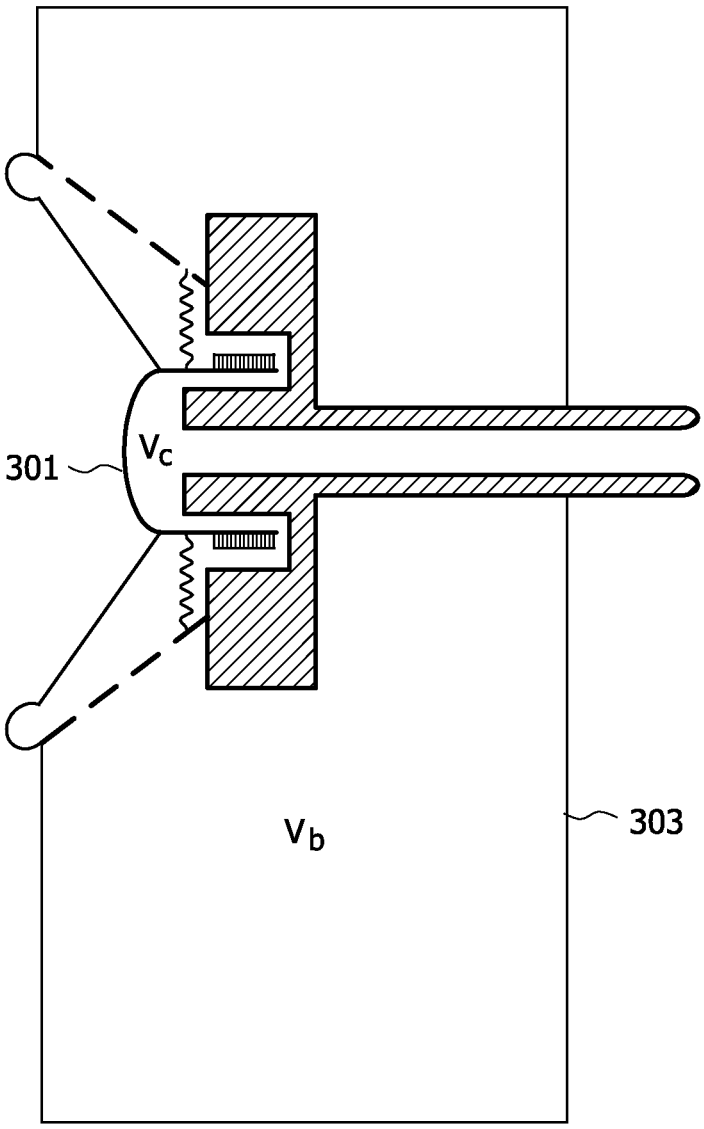
FIG. 3 illustrates an example of a cross sectional view of a speaker arrangement in accordance with some embodiments of the invention.

FIG. 3 illustrates an example of the audio driver 301 of FIG. 1 mounted in a speaker enclosure 303. As illustrated, the enclosure 303 forms a closed cabinet with the air conduit 115 extending out of the enclosure thereby allowing the generated air jet to be directed e.g. towards any outside element that needs to be cooled by an air flow.

In the example, the closed cabinet enclosure 303 may be designed to provide the desired audio characteristics without considering the air flow functionality. Specifically, the internal closed volume $V_b$ simply acts as an extra spring on the diaphragm and can accordingly be dimensioned to provide the desired acoustic behaviour as will be known to the skilled person. The specific example of FIG. 3 thus provides a speaker arrangement wherein sound is radiated in a first direction of the diaphragm (i.e. in a forwards direction being the direction from the diaphragm away from the transducer element). At the same time an air flow in the form of an air jet is generated and directed in a rearwards direction.

Figure 4:
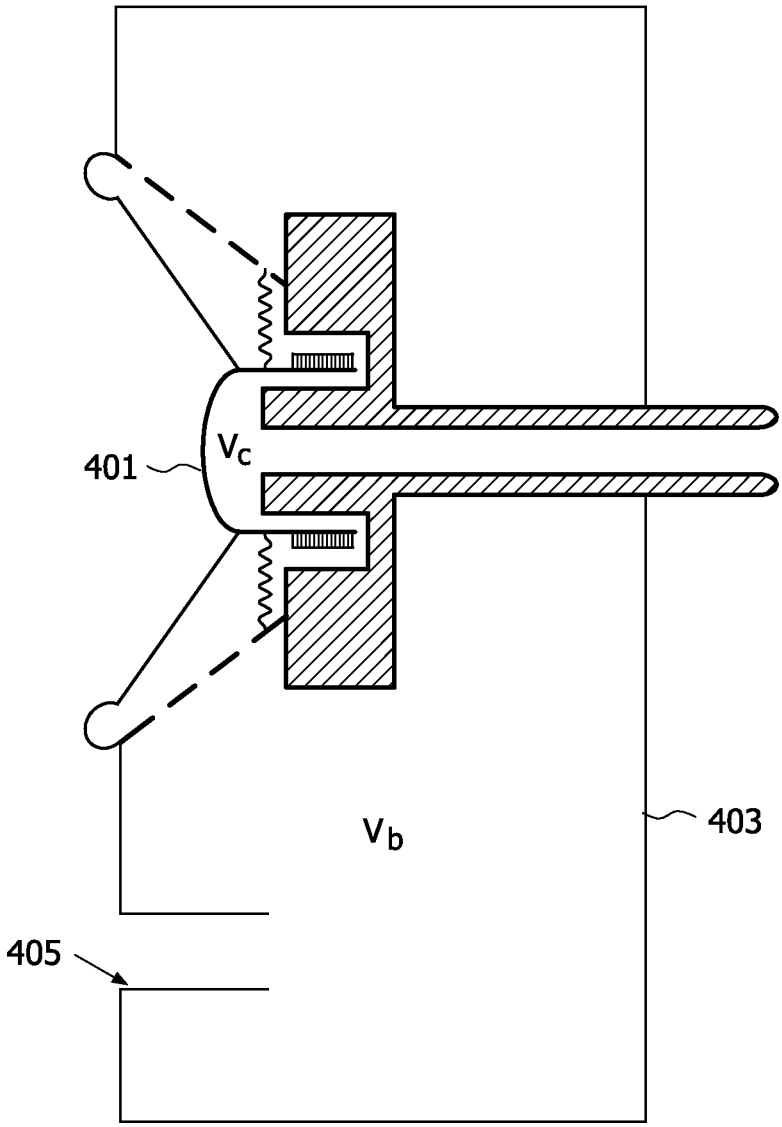
FIG. 4 illustrates an example of a cross sectional view of a speaker arrangement in accordance with some embodiments of the invention.

FIG. 4 illustrates another example of the audio driver 401 of FIG. 1 mounted in a speaker enclosure 403. In this example, the enclosure 403 includes a bass reflex port 405 which can be used to further enhance lower frequencies of the generated sound. The bass reflex can be tuned to a low frequency thereby extending the effective frequency range of the audio driver 401.

In both the examples of closed cabinet and a bass reflex port, as well as for many other implementations, the resonance frequency of the cavity and conduit is kept lower than the resulting (lowest) system resonance frequency. Specifically, when mounting the audio driver in an enclosure, the free air acoustic resonance frequency of the audio driver may be modified by the enclosure to provide an acoustic resonance frequency of the combined system which is typically lower than the free air acoustic resonance frequency of the audio driver.

Thus, whereas these system acoustic resonance frequencies may be lower than the free air resonance frequency of the audio driver, they are still typically designed to be higher than the air flow resonance frequency. In many embodiments, advantageous performance is achieved by the system resonance frequency of the speaker arrangement being no less than 30%, 50% or even 100% higher than the air flow resonance frequency. E.g. for the system of FIG. 4, the resonance frequency of the bass reflex port 405 is designed to be substantially higher than the air flow resonance frequency.

This ensures that the air flow functionality and the sound production functionalities are still effectively decoupled despite the mounting of the audio driver in the enclosure and the resulting extension of the effective frequency range. For example, if the bass reflex cabinet of FIG. 4 is tuned to 60 Hz, the air flow functionality may be tuned to 30 Hz. At this frequency the bass reflex cabinet is very inefficient in producing sound, because the sound pressure of the port and cone effectively cancel each other out. For frequencies of 60 Hz and above, the air flow functionality becomes very inefficient, whereas the sound generation becomes very efficient in this range. As another example, if the closed box resonance frequency of the speaker arrangement of FIG. 3 is tuned to 60 Hz, the air flow functionality may be tuned to 30 Hz. Accordingly, the air flow effect will have a maximum output at 30 Hz. However, at this frequency the closed box cabinet is very inefficient when producing sound. However, for frequencies of 60 Hz and above, the closed box is very efficient, and the air flow functionality becomes increasingly less efficient.

It will be appreciated that the described approaches may be used for many different applications. For example, the described audio driver may be used to generate a cooling air flow that can be directed towards an element or area to be cooled. Furthermore, the use of an elongated air conduit (such as a pipe or a tube) may facilitate this air flow being directed towards the area or element to cool. Indeed, in some embodiments the air conduit may at least partly be generated using flexible material such that the air conduit can easily be manually modified to direct the air jet in the desired direction. Furthermore, this efficient cooling can be achieved while at the same time providing sound production of relatively high quality. Thus, the same audio driver may be used simultaneously for a plurality of purposes thereby reducing cost and complexity. For example, a computer may use an audio driver both for providing a sound output and for providing internal cooling. Such implementations may e.g. be particularly suitable for portable computers, such as laptops, where a small form factor is critical.

However, the generated air flow may also be used for other applications such as for example to generate a haptic output to a user. For example, the air conduit may be directed towards a user such that the air jet can be felt by the user. This may for example provide enhanced effects for virtual applications (e.g. games) or may be used for multi-modal feedback. E.g. an air flow directed towards a user's face may be used as an alarm indication.

It will be appreciated that the above description for clarity has described embodiments of the invention with reference to different functional units and elements. However, references to specific functional units are only to be seen as references to suitable means for providing the described functionality rather than indicative of a strict logical or physical structure or organization.

The elements and components of an embodiment of the invention may be physically, functionally and logically implemented in any suitable way.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc do not preclude a plurality. Reference signs in the claims are provided merely as a clarifying example shall not be construed as limiting the scope of the claims in any way.

The invention claimed is:

1. An audio driver comprising:

a diaphragm for radiating sound, the diaphragm having a first side and a second side and being arranged such that a part of the diaphragm at least partly forms a cavity at the second side;

a transducer element coupled to the diaphragm on the second side and arranged to convert an electrical input signal into movement of the diaphragm; and an air conduit coupled to the cavity and having a first opening into the cavity and a second opening outside the cavity;

wherein the audio driver has a free air acoustic resonance frequency and the air conduit and cavity are configured to form a Helmholtz resonator having a resonance frequency which is less than half of the free air acoustic resonance frequency of the audio driver.

2. The audio driver of claim 1, wherein the diaphragm has a surface area and a surface area of the part of the diaphragm that at least partially forms the cavity is less than 20% of the surface area of the diaphragm.

3. The audio driver of claim 1, wherein the resonance frequency is not above 100 Hz.

4. The audio driver of claim 1, wherein the air conduit comprises a pipe having a length at least three times longer than a maximum cross-sectional dimension of the pipe.

5. The audio driver of claim 1, wherein an area of the second opening is sufficiently small to provide jet formation for air expelled through the second opening as a consequence of the movement of the at least part of the diaphragm.

6. The audio driver of claim 1, wherein the part of the diaphragm that at least partially forms the cavity is located at a central part of the diaphragm.

7. The audio driver of claim 1, wherein the air conduit is at least partly formed through the transducer element.

8. The audio driver of claim 1, wherein the transducer element comprises a voice coil and a permanent magnet, the diaphragm is coupled to the voice coil, and the cavity is at least partially formed by the permanent magnet.

9. The audio driver of claim 1, comprising:

an enclosure; and the audio driver of claim 1 mounted in the enclosure.

10. The audio driver of claim 9, wherein the second opening is outside the enclosure.

11. The audio driver of claim 10, wherein a system acoustic resonance frequency of the speaker arrangement is at least 50% higher than the resonance frequency of the cavity and the air conduit.

12. The audio driver of claim 11, wherein the system acoustic resonance frequency is a resonance frequency of a bass reflex port for the audio driver.

13. The audio driver in accordance with claim 1, further comprising a drive unit for generating the electrical input signal to comprise a narrowband air flow drive signal component and an audio signal component, the narrowband air flow drive signal having a center frequency closer to the resonance frequency of the Helmholtz resonator than to the free air acoustic resonance frequency of the audio driver.

14. The audio driver of claim 1, wherein the audio driver is further configured to perform a cooling operation.

15. The audio driver of claim 1, wherein the cavity has an opening and is situated between the transducer element and the part of the diaphragm that at least partially forms the cavity.

16. The audio driver of claim 15, wherein the opening of the cavity is the same as the first opening of the air conduit.

17. A method of generating an air flow, the method comprising acts of:

providing an audio driver comprising:

a diaphragm for radiating sound, the diaphragm having a first side and a second side and being arranged such that a part of the diaphragm at least partly forms a cavity at the second side;

a transducer element coupled to the diaphragm on the second side and arranged to convert an electrical input signal into movement of the diaphragm; and an air conduit coupled to the cavity and having a first opening into the cavity and a second opening outside the cavity wherein the audio driver has a free air acoustic resonance frequency and the air conduit and cavity are configured to form a resonator having a resonance frequency which is less than half of the free air acoustic resonance frequency of the audio driver;

generating an electrical drive signal comprising an air flow signal component and an audio signal component; and feeding the electrical drive signal to the transducer element as the electrical input signal.

* * * * *